United States Patent [19]

Daar et al.

[11] 4,079,741

[45] Mar. 21, 1978

[54] HAIR PLUCKING DEVICE

[76] Inventors: Yair Daar, 9 Rav-Ashi Street, Tel Aviv; Shimon Yahav, 11 Moshe Mizrachi St., Rehovot, both of Israel

[21] Appl. No.: 736,470

[22] Filed: Oct. 28, 1976

[30] Foreign Application Priority Data

| | | |
|---|---|---|
| Dec. 9, 1975 | Israel | 48625 |
| Aug. 12, 1976 | Israel | 50246 |

[51] Int. Cl.[2] ..... A61B 17/00

[52] U.S. Cl. ..... 128/355; 17/47

[58] Field of Search ..... 17/47; 128/355

[56] References Cited

U.S. PATENT DOCUMENTS

| | | | |
|---|---|---|---|
| 1,232,617 | 7/1917 | Shipp | 128/355 |
| 1,743,590 | 1/1930 | Binz | 128/355 |
| 2,004,581 | 6/1935 | Meyer | 128/355 |
| 2,083,380 | 6/1937 | Hudson | 128/355 |
| 2,900,661 | 8/1959 | Schnell | 128/355 UX |

*Primary Examiner*—Robert W. Michell
*Assistant Examiner*—Michael H. Thaler
*Attorney, Agent, or Firm*—Ostrolenk, Faber, Gerb & Soffen

[57] ABSTRACT

A skin-hair plucking device including a compact coiled member within a housing with a substantially smooth external surface exposed for the slidable engagement with the skin and motor driven means for alternately extending and reclosing the windings.

10 Claims, 12 Drawing Figures

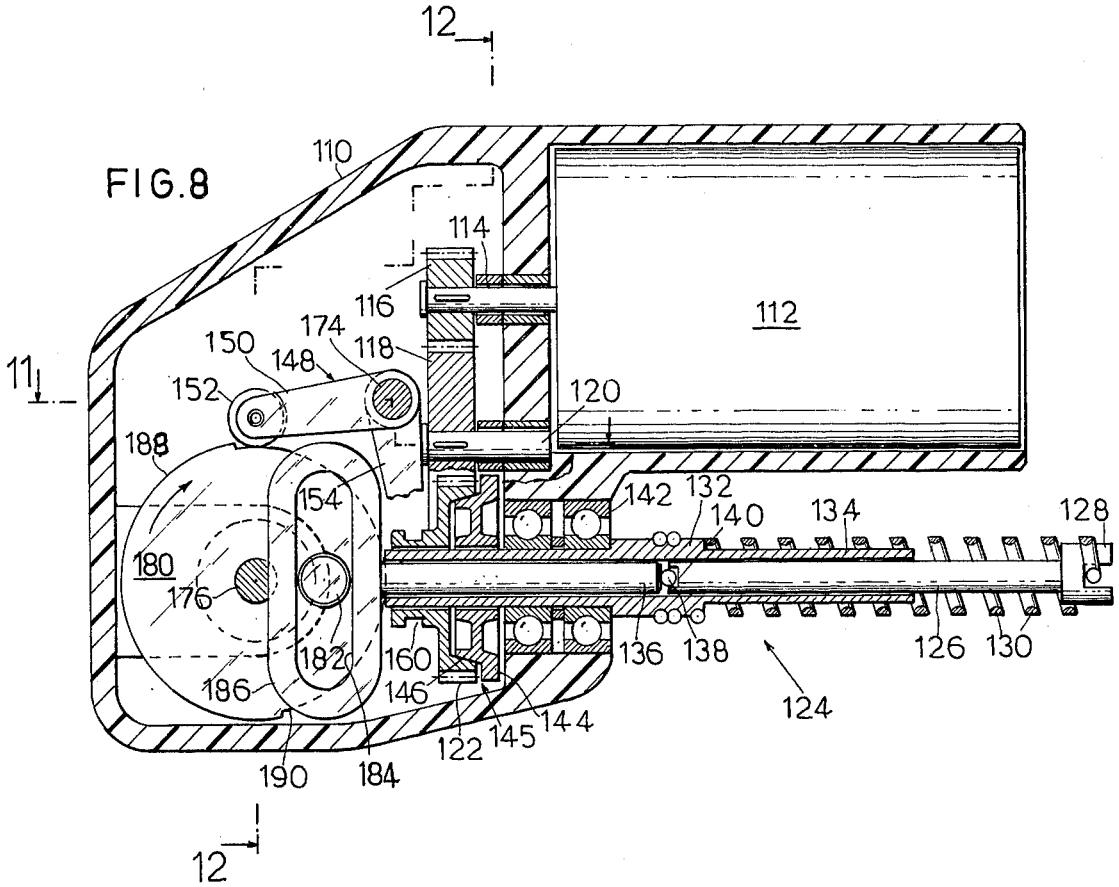
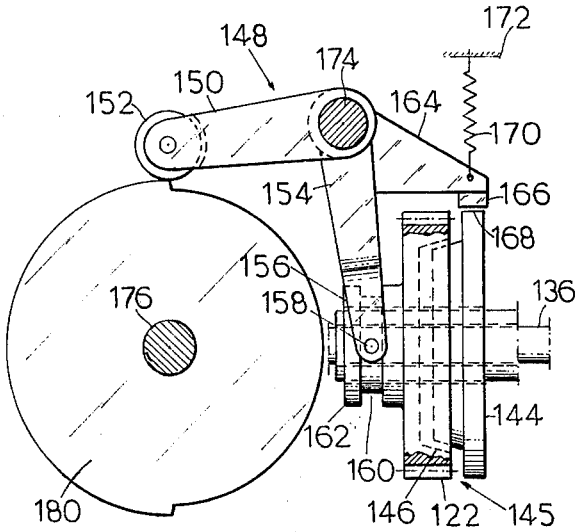
FIG.9
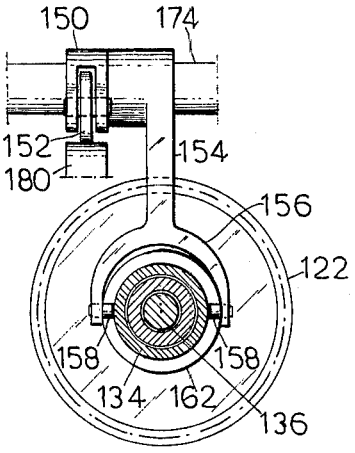
FIG.10

HAIR PLUCKING DEVICE

The present invention relates to power operated apparatus for skin-hair plucking, mainly for feminine cosmetic purposes.

There are known mechanical hair extractor devices and apparatus, generally falling into two main categories, namely, manually operated and power driven. The manual devices employ a coil-spring, adapted to be extended for allowing hair to project between its coils or convolutions, re-closed for gripping the hair and pulled sharply away from the skin.

The power-operated apparatus comprise a pencil-like hollow handle carrying a stem-like rotatable hair extracting unit, the unit having hair grasping faces arranged to present an annular slot-like opening for receiving hairs, the opening being periodically closed and opened during and by the rotation of the unit.

The devices of the first above-mentioned type are not efficient and painful in use, whereas the apparatus of the other type have very limited capacity, besides being of complicated construction.

It is the general object of the present invention to overcome the deficiencies of the known mechanical hair extractions.

It is a further object of the invention to provide a hair extracting power operated apparatus based on the coil spring action but by far more effective than in the hand operated devices.

It is a still further object of the invention to provide an apparatus wherein the coil spring is adapted to rotate and to reciprocate at the same time.

A still further object of the invention is to incorporate in the apparatus control means for both the rotational and the reciprocal motions of the coil spring.

According to the broadest aspect of the invention, there is provided an apparatus for skin-hair plucking, comprising a portable housing, a member having a plurality of closed helical windings, defining a substantially smooth external surface, installed in the housing so that said surface is at least partly exposed for the slidable engagement with the skin, motor driven reciprocating means for alternately extending said member so that said windings become spaced from each other and then re-closed one against the other, and motor driven means for rotating said member.

The said member may be constituted by a normally closed coil spring and said reciprocating means comprising a bar extending within said spring and coupled to one end of said spring, the other end of said spring coupled to a sleeve rotatably mounted on said housing, and rotatable cam means provided in the housing for reciprocating the said bar.

The spring-and-bar assembly may be simultaneously driven by the same motor, the arrangement being such that hairs clamped between adjacent windings during the re-closing of the spring will be instantaneously plucked due to the said rotation of the spring over the treated skin.

Preferably, the rotational movement of the spring should be slowed down or even momentarily stopped every cycle, in order to secure that the hair would in fact be clamped between the spring windings rather than bent away because of the air turbulence generated by the necessarily high peripheral velocity thereof.

Further features of construction will become apparent from the ensuing description of a few selected preferred embodiments of the invention, given below by way of example only with reference to the attached drawings, in which:

FIG. 8 is a cross-sectional elevation of the apparatus according to a third embodiment of the present invention;

FIG. 9 shows the friction clutch and braking assemblies;

FIG. 10 is a side view of FIG. 9;

Figure 1:
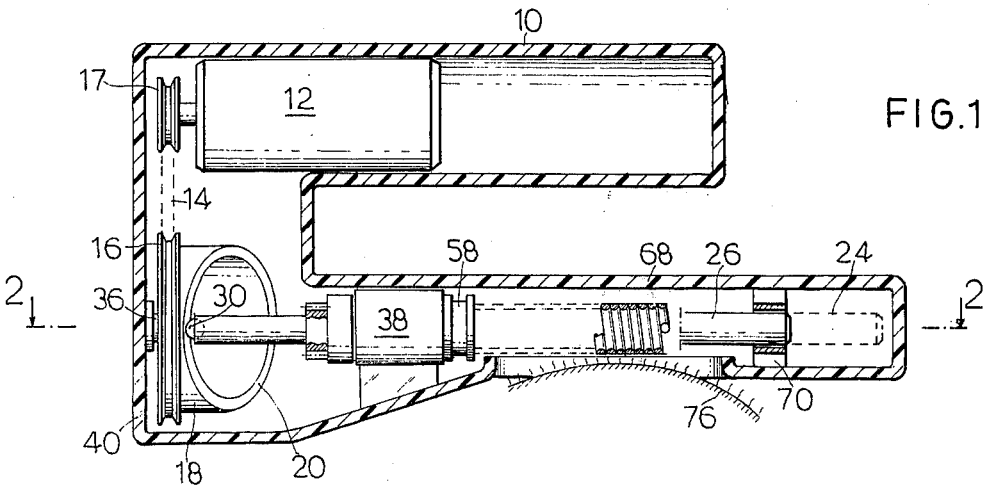
FIG. 1 is a cross-sectional elevation of the apparatus according to a first embodiment of the present invention, taken along line 1 — 1 of FIG. 2.

In FIG. 1, the housing of the hair-plucking apparatus comprises a handle section 10 used also for enclosing the electric motor 12. The motor 12 is coupled, through the "V" belt 14 or any other suitable transmission means, to the cam support member 16. The cam 18 represents an inclined, preferably hardened and polished peripheral surface 20 where the two bars 24 and 26 are slidingly engaged by their ball-shaped tips 28 and 30 as will be explained below. The cam 18 is keyed as shown to the shaft 32 which is rotatably mounted on bearings 34 and 26 provided at the bridge-section 38 and at the side wall 40 of the housing, respectively.

There is mounted on the shaft 32 a gear wheel 42 which meshes with a pair of gears 44, 46. Gears 44 and 46 are fixedly connected to the slide bearings or sleeves 48 and 50 to drive same, the arrangement being such that the bars 24, 26 are slidably and rotatably guided within the bearings following the curvature of the cam track 20 as well as the rotational movement of the gears 44, 46 (and bearings 48, 50).

Alternatively, as will be explained below, the bars may not be rotatable but still adapted to be operated to-and-fro by the cam.

Figure 4:
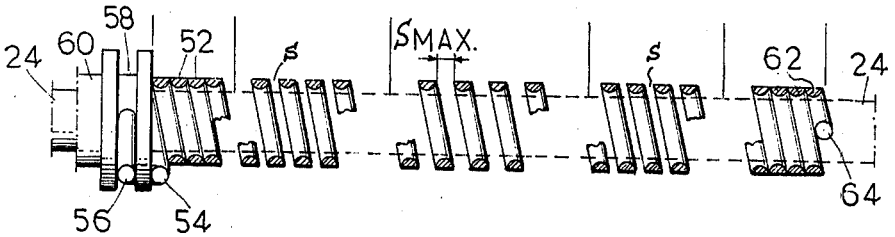
FIG. 4 is a diagrammatic representation of the spring-and-bar assembly in various deflection phases of the spring.

As more clearly seen in FIG. 4, the bar 24 (and the same applies to bar 26) extends within a compression (normally closed) spring 52, preferably made of steel wire having a semi-circular cross-section. This wire configuration may be achieved by grinding off the outer half of a common round wire spring. The extreme left-hand winding 54 of the spring 52 is so bent as to form an extension 56 that fits into a groove 58 of the extension 60 of the sleeve 48. The other, right-hand end winding 62 of the spring 52 is fastened to the bar 24 e.g. by inserting the twisted end of the wire into a suitable bore 64.

Figure 6:
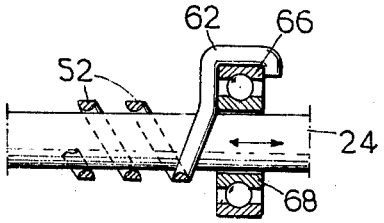
FIG. 6 shows an arrangement for a free-wheel connection between the spring and the bar.

Should it be elected, according to a modified embodiment of this invention, that the spring would only rotate together with the sleeve 48, while the bar 24 executes the back-and-forth movement, the arrangement of FIG. 6 may be applicable.

As shown, the end winding 62 is bent over and fastened to the outer ring 66 of a ball bearing, the inner ring 68 being secured to the bar 24, at a location corresponding to the closed position of the spring 52.

Referring back to FIGS. 1 and 2, the housing further comprises a flat back plate 68 bent over as shown and enclosing the cross member 70 which accommodates the bearings 72, 74 for the free ends of bars 24 and 26. These bearings provide better alignment and support for the bars, especially when performing both linear and rotational movements.

Figure 5:
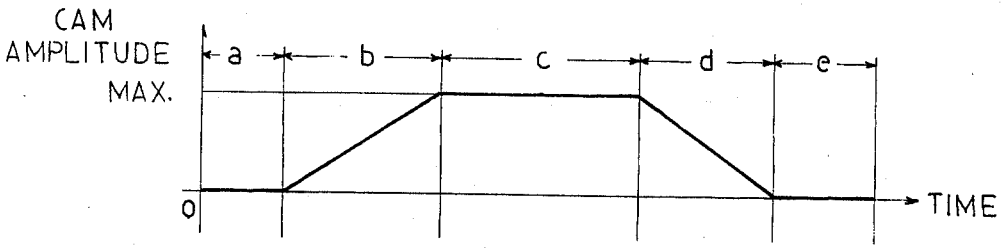
FIG. 5 is a diagram of the cam amplitude in relation to the deflection of the spring of FIG. 4.

The operation of the apparatus is as follows: In the position shown in FIG. 2, bar 26 is in the extreme inward position thereof, i.e. the compression spring 53 is free from any external force, and the windings are closed. This state is represented in FIGS. 4 and 5 as phases "a" and "e", where the cam amplitude is zero.

Bar 24 at the same time is at the pick stroke, corresponding to the cam's max. amplitude (phase "*c*"), with space S (max) formed between adjacent windings of the spring 52.

Now, when the motor 12 starts to run, say, at 500 r.p.m. the cam 18, driven by wheel 16 (which is larger than the motor's driving wheel 17) will rotate at, say, 200 r.p.m.which means that the reciprocal movement of the bars 24 and 26 will be 200 strokes per minute.

Simultaneously, gear 42 will rotate at the same speed of 200 r.p.m. transmitting an increased speed of (if the ratio is 2:1) 400 r.p.m. to the gears 44 and 46 and via the bearings 48, 50 to the springs 24 and 26.

Figure 2:
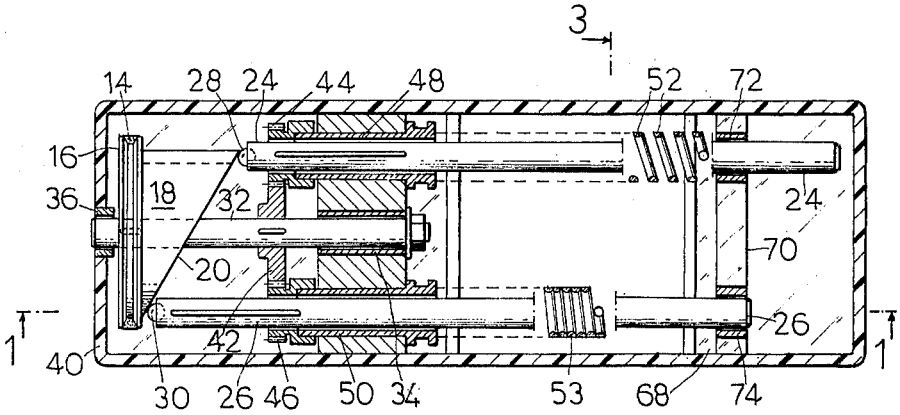
FIG. 2 is a cross-section along line 2 — 2 of FIG. 1.
Figure 3:
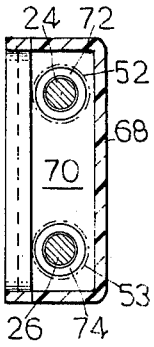
FIG. 3 is a cross-section along line 3 — 3 of FIG. 2.

Should the springs be coupled to the bars as in FIGS. 1, 2 and 4, then the bars will rotate together with their associated spring; however, should the arrangement of FIG. 6 be employed (preferably together with some additional rotation blocking means such as splines or by forming the bars and their respective bearings of a square or hexagonal cross-section), then the bars will not rotate but only reciprocate following the curvature of the cam.

Preferably, the curvature of the cam surface 20 would be so designed (see FIG. 5) that between the gradually opening (phase "*b*") and closing (phase "*d*") of the spring, the latter will be maintained open (phase "*c*") for about a quarter of the whole cycle (corresponding, in the above illustrated example, to a period of less than 1 second). This would contribute to the gripping capability of the apparatus.

In use, the device would be held by the handle 10 and the exposed springs' sections be rubbed against the hairy skin 76 (FIG. 1). During the phase "*c*", and at least part of phases "*b*" and "*d*", some hair would necessarily project into the open spaces S, and, towards the end of the closing phase "*d*", be clamped between adjacent windings. Since the springs rotate at high peripheral velocity, the gripped hair would abruptly be plucked and removed, while still assuring minimum pain to be suffered by the user.

Figure 7:
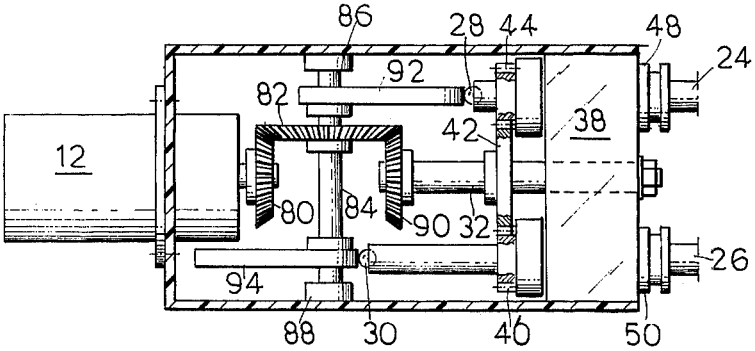
FIG. 7 is a cross-sectional plan view of a second embodiment of the invention.

FIG. 7 illustrates a modified driving mechanism for operating the bars 24 and 26, it should, however, be emphasized that a large variety of equivalent arrangements may be applied for the purpose in question, such as rack-and-pinion assemblies, Geneva Drives, ratchet or friction clutches, toggle linkages, electric solonoids, pneumatic cylinders and many other devices known per se in the art.

In FIG. 7 the same reference numbers have been used for denoting identical or related parts previously mentioned.

The motor 12 is coupled intermediate conical gear wheels 80 and 82 to the shaft 84 suitably supported by bearings 86, 88. Further coupled to the motor, via the shaft 32 and gears 90, 82 and 80, are the gear-wheel trains 42–44, and 42–46 for rotating the sleeves 48, 50, as described in connection with the former embodiment of the present invention.

On the shaft 84 there are provided a pair of eccentrically mounted discs 92, 94. The disc 92 is rotated by 180° with respect to the disc 94, for the alternate operation of the bars 24 and 26, this feature, being of course, optional, and any other off-setting relation of the discs is equally applicable.

The contours of the discs 92, 94 engaged by the ball-points 28, 30 of the bars 24, 26 may again be so designed to establish the desirable mode of operation represented in FIGS. 4 and 5.

In all other respects, the functioning of this modified hair plucking apparatus is similar to that described in conjunction with the former embodiment of the present invention.

The apparatus shown in FIGS. 8–12 comprises the housing 110 for the electric motor 112, and the driving assemblies, which include:

a. the spring rotating assembly;
b. the intermittent spring rotation discontinuing assembly; and
c. the spring-bar reciprocating movement assembly.

The motor 112 has an output shaft 114 on which there is mounted the pinion 116. The gear 118, rotatable about the shaft 120, is meshed on the one hand with the pinion 116 and on the other hand with the pair of gears 122 (see FIG. 12).

There are provided a pair of spring reciprocating mechanisms 124 (only one being shown in FIG. 8), each comprising the spring bar 126 having bifurcated head 128 for holding one end of the spring 130. The other end of the spring 130 is fastened onto the increased diameter portion 132 of the sleeve 134. The bar 126, as well as the rod 136 coaxial therewith, are freely held within the sleeve 134, a point-bearing being provided therebetween in the form of the ball 138 centrally located and retained by the socket 140.

The active part of the spring 130 has a half-circular or any other cross-section suitable for the purposes of the invention, as already above-mentioned.

The sleeve 134 is rotatably held relative to the housing 110 by the ball bearings 142 so that it may rotate about the rod 136 when rotational movement is applied to the friction disc 144 of the friction clutch 145, keyed or press-fitted on the sleeve 134. This will occur upon the engagement of the counter-friction disc 146 which forms part of the gear wheel 122.

As better seen in FIGS. 9 and 10, the friction clutch 145, comprised of the conical projection and recess of the discs 144 and 146, respectively, is adapted to be actuated by the pivotable elbow-like lever 148 having a first arm 150 carrying the cam roller 152, and a second arm 154, having a bifurcated end portion 156 provided with a pair of aligned projections 158. The projections 158 are so located and distanced that they are in a diametrically opposite position with respect to the annular slot 160 of the extended cylindrical portion 162 of the gear wheel 122.

The arm 154 is further provided with an extension 164 overhanging the gear wheel 122 and the friction disc 144 and provided at its end with a brake-shoe member 166 adapted to engage upon actuation (disconnection) of the friction clutch 145 a peripheral friction surface 168 of the disc 144. The extension 164, together with the complete arm 154, is upwardly attracted by the spring 170 anchored at 172 to a suitable fixed point (not shown) of the housing 110.

An axle 174 is provided, extending transversely across the housing 110 (see FIG. 12), about which the pair of arms 148 are adapted to pivot.

Figure 12:
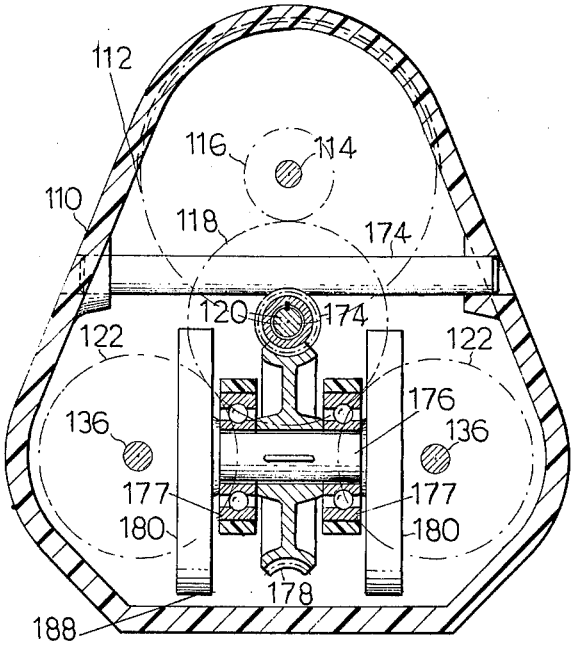
FIG. 12 is a cross-section along lines 12 — 12 of FIG. 8.
Figure 11:
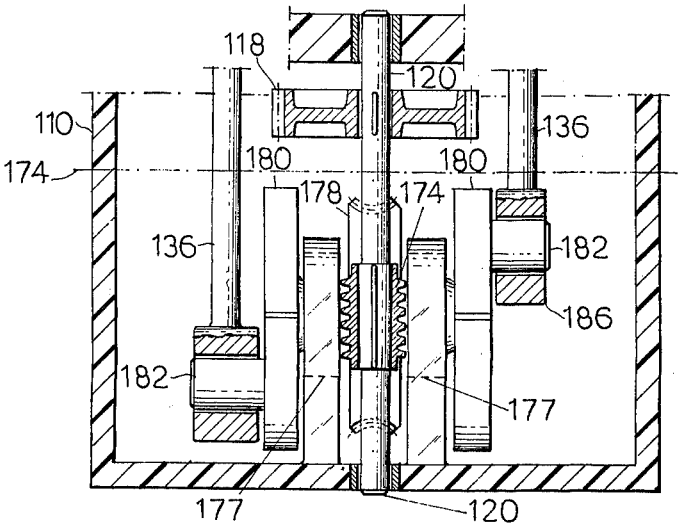
FIG. 11 is a cross-section along line 11 — 11 of FIG. 8.

The spring-bar reciprocating movement assembly will now be described with specific reference to FIGS. 11 and 12. The shaft 120 of the gear 118 is further extended and carries a worm gear 174. The worm wheel 178 is supported by the shaft 176, rotatably mounted on the ball bearings 177. Two discs 180 are keyed to both free ends of the shaft 176, each being provided with the crank pin 182 projecting from one side wall thereof, but in diametrically opposite relative positions (for better dynamic balance purposes), as shown. Each pn 182 is located within the vertical slot 184 defined by the crankcase member 186 rigidly connected to the free end of the rod 136 (FIG. 8).

The discs 180 are further provided with different diameter cam surfaces 188 and 190 for sequentially displacing the cam follower 152 pressed thereagainst through the action of the spring 170.

The operation of the device is as follows: The rotation of the pinion 117 is transmitted to the gear 118, thus driving the shaft 120 and the gears 122. In the position shown in FIG. 8, the cam roller 152 engages the smaller diameter section 190 of the disc 180, and consequently projections 158 (FIG. 10) press the conical friction surface of the disc 146 against the complementary surface of the disc 144. Of course any other suitable friction, magnetic or the like known releasable clutch devices may be employed for the purposes in question.

Now that discs 144 and 146 rotate together, sleeve 134 which is secured to disc 144 rotates about the rod 136 to impart the necessary rotational movement to the hair-plucking spring 130.

Should the enlarged cam surface 188 engage the roller 152 (FIG. 9) (after further rotation of the discs 180, as will be described below), the arm 148 will pivot about the shaft 174 against the tension of the spring 170 to release the discs 146 and 144 from each other, and, immediately thereafter, to brake the free-running rotation (by inertia) of the bar 126, spring 130, sleeve 134, and disc 144 by the brake-shoe 166 being pressed against the outer surface 168 of the disc 144. The continuous rotation of the gears 122 and back-and-forth movement of the bar 126 would not be interfered by the spring rotating assembly being slowed down and preferably coming to a complete standstill.

The reverse sequence of operations will occur upon the cam follower 152 being relieved from its elevated position governed by the surface 188 (FIG. 9) and restore its first above-mentioned clutch-engaging position (FIG. 8).

The rotation of the gear 118 is also transmitted, through the worm gear-train 174–178, to the shaft 176 which drives the crank discs 180, however, at a lower speed corresponding to the worm gear transmission ratio. Typical preferred ratio of spring-rotations per stroke has been found to be 25–40:1.

The rotation of the discs 180, besides causing the actuation of friction clutch 145 as above-described, generates the reciprocating movement of the spring 130, in the following manner. As the crank pin 182 revolves, the crankcase member 186 is dragged to the left (FIG. 8) during the lower half of a revolution, and pushed to the right during the upper half; since the spring 130 applies a tension force on the spring bar 126, whether or not rotated by the sleeve 134, contact between the ball-point bearing 138 and the rod 136 would never be broken. Therefore, the back-and-forth movement of the crankcase 186 would be directly transmitted to the spring 130 irrespective of its operational phase, namely revolving, stationary or intermediate positions therebetween.

The relative disposition of the cam surfaces 188 and 190 on the one hand, and the pins 182 on the other hand, is preferably preset so that the rotation of the spring would be interrupted on, or closely before its complete expansion (pins 182 at the extreme righthand position), and abruptly set into movement right after the windings get hold of the hair.

It is thereby assured that the effect of the relatively high peripheral velocity of the spring windings, creating such air turbulence as to prevent individual hair from projecting into the gaps between the windings, when available, is neutralized through the introduction of the "stand-still" phase into every cycle of operation. Furthermore, this special feature allows not only to maintain but even to increase said velocity by any reasonable extent required for effectively minimizing the pain suffered by the treated person. All these operational parameters — namely the rates of the spring expansions, revolutions, and stops — as well as the timing thereof, are readily adjustable to attain optimal working conditions by the improved construction of this preferred embodiment of the present invention.

Having now described in particular the main principles, constructional features and advantages of the present invention, it would be readily appreciated by those skilled in the art that many variations and modifications may be applied with respect to the illustrated embodiments without departing from the spirit and scope thereof as defined in the appended claims. For example: The cross-section of the spring wire may be triangular or square, rather than semi-circular; any given number of bar-and-spring assemblies may be comprises in a single device, and operated by one and the same motor.

What is claimed is:

1. Apparatus for skin-hair plucking, comprising a portable housing, a compact coiled member having a plurality of closed helical windings, defining a substantially smooth external surface, installed in the housing so that said surface is at least partly exposed for the slidable engagement with the skin, motor driven reciprocating means for alternately extending said member so that said windings become spaced from each other and then re-closed one against the other, and motor driven means for rotating said member.

2. The apparatus of claim 1 wherein said member is a normally closed coil spring.

3. The apparatus of claim 2 wherein said reciprocating means comprise a bar extending within said spring and coupled to one end of said spring, the other end of said spring coupled to a sleeve rotatably mounted on said housing, and rotatable cam means provided in the housing for reciprocating the said bar.

4. The apparatus of claim 3 further comprising transmission means for rotating the said spring by said motor.

5. The apparatus of claim 4 wherein said transmission means are coupled to said sleeve, and include a clutch and clutch controlling means for cyclically discontinuing the rotation of said spring.

6. The apparatus of claim 5 wherein said bar is slidably and rotatably mounted within said sleeve and coupled via a cam follower at its other end to an eccentric cam.

7. The apparatus of claim 5 wherein said bar is slidably and rotatably mounted within said sleeve and coupled to a crank pin projecting from a rotatable crank disc driven by said transmission means.

8. The apparatus of claim 7 wherein said clutch comprises a first friction disc fixedly mounted on said sleeve, a second friction disc rotatably and slidably mounted on said sleeve, and normally spring biassed against said first disc, said transmission means being coupled to said second disc, and said clutch controlling means comprise displaceable means operatively connected to said disc for disengaging said second disc from said first disc.

9. The apparatus of claim 8 wherein said displaceable means comprise a pivotally supported lever member coupled at one end thereof to said second disc to displace it from said first disc upon the actuation of the lever by means of a cam-follower provided at the other end of the lever and adapted to be engaged by a revolving surface of said crank disc.

10. The apparatus of claim 7 wherein brake means are provided for braking the free-running rotation of said first disc after it becomes disengaged from said second disc.

* * * * *